US007461989B1

(12) United States Patent
Dickover et al.

(10) Patent No.: US 7,461,989 B1
(45) **Date of Patent: *Dec. 9, 2008**

(54) PEN RETENTION APPARATUS

(75) Inventors: Wesley D. Dickover, Stuart, FL (US); Dean F. Herring, Youngsville, NC (US); Philip M. Woodward, Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/113,236

(22) Filed: May 1, 2008

Related U.S. Application Data

(63) Continuation of application No. 11/939,929, filed on Nov. 14, 2007.

(51) Int. Cl.
*B43K 23/02* (2006.01)

(52) U.S. Cl. ..... 401/131; 401/48; 401/88; 401/195

(58) Field of Classification Search ..... 401/131, 401/48, 88, 195
See application file for complete search history.

(56) References Cited

U.S. PATENT DOCUMENTS

| | | | | |
|---|---|---|---|---|
| 1,506,207 | A * | 8/1924 | Wahl | 401/131 |
| 1,511,167 | A * | 10/1924 | Jesnig | 211/69.1 |
| 3,570,284 | A * | 3/1971 | Hendricks | 401/195 |
| 4,236,841 | A | 12/1980 | Jongeward | |
| 5,123,548 | A * | 6/1992 | Milne | 401/88 |
| 5,379,928 | A * | 1/1995 | Mikkelsen | 224/257 |
| 5,815,873 | A * | 10/1998 | Jones | 15/106 |
| 5,947,623 | A * | 9/1999 | Smith | 401/131 |
| 6,167,596 | B1 | 1/2001 | Berman | |
| 6,318,921 | B1 * | 11/2001 | Craine | 401/131 |
| 6,394,677 | B2 * | 5/2002 | Wang | 401/6 |
| 7,252,450 | B2 | 8/2007 | Aguirre et al. | |
| 2004/0026556 | A1 * | 2/2004 | Kish | 242/380 |

FOREIGN PATENT DOCUMENTS

| | | | |
|---|---|---|---|
| GB | 2288150 | A | 10/1995 |

* cited by examiner

*Primary Examiner*—Khoa D Huynh
(74) *Attorney, Agent, or Firm*—Cantor & Colburn LLP; Jason O. Piche

(57) ABSTRACT

A pen retention device for releasably securing a pen to a tether is disclosed. The device includes the pen having an end and an annular interior surface defining a bore, a cap comprising an expandable retention interface disposed within the bore proximate the end, and an anvil securedly attached to the tether. The expandable retention interface includes a radially outwardly directed surface in contact with the annular interior surface. The expanding retention interface further includes a radially inwardly directed surface in operable communication with the anvil. The expanding retention interface is responsive to an application of force less than a release force by the tether via the anvil to expand and secure cap to the pen, and is responsive to an application of force greater than the release force to release the cap from the pen.

3 Claims, 2 Drawing Sheets

PEN RETENTION APPARATUS

CROSS REFERENCE TO RELATED APPLICATION

This application is a Continuation application of U.S. Ser. No. 11/939,929, filed Nov. 14, 2007, the contents of which are incorporated by reference herein in their entirety.

BACKGROUND OF THE INVENTION

1. Field of the Invention

This invention relates generally to pen retention devices, and particularly to point of sale signature pen retention devices.

2. Description of Background

Point of sale devices may provide pens, such as electronic signature pens for example, for a shopper to authorize a sale transaction. It is important to retain and secure the pen in a location that is convenient for use and such that it cannot easily be taken by the shopper. Typical pen retention arrangements include a tether attached to the pen and a retracting reel, such that the tether is drawn into the retracting reel when the pen is not in use. The pen is intended to be disposed within an accompanying recess such that the pen does not obstruct a flow of purchased products. To discourage any pilferage of the pen, tether, and retracting reel, the retracting reel is often disposed beneath a surface of the point of sale device, such that it is inaccessible to the shopper.

Failure by the shopper to ensure proper return of the pen to the accompanying recess may result in the pen becoming entangled with the flow of purchased products, application of excessive tether force, and failure of either the tether or the retracting reel. Repair of such tether or retracting reel failure requires a service technician to disassemble the point of sale device and replace the retracting reel, tether, pen. Accordingly, there is a need in the art for a pen retention arrangement that overcomes these drawbacks.

SUMMARY OF THE INVENTION

An embodiment of the invention includes a pen retention device for releasably securing a pen to a tether. The device includes the pen having an end and an annular interior surface defining a bore, a cap comprising an expandable retention interface disposed within the bore proximate the end, and an anvil securedly attached to the tether. The expandable retention interface includes a radially outwardly directed surface in contact with the annular interior surface. The expanding retention interface further includes a radially inwardly directed surface in operable communication with the anvil. The expanding retention interface is responsive to an application of force less than a release force by the tether via the anvil to expand and secure cap to the pen, and is responsive to an application of force greater than the release force to release the cap from the pen.

Additional features and advantages are realized through the techniques of the present invention. Other embodiments and aspects of the invention are described in detail herein and are considered a part of the claimed invention. For a better understanding of the invention with advantages and features, refer to the description and to the drawings.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION OF THE INVENTION

An embodiment of the invention provides a pen retention device to releasably secure the pen to the tether. The pen retention device releases the pen from the tether before application of a force likely to damage either of the tether or the retracting reel. The pen retention device further allows replacement of the pen subsequent to such release without need for a service technician to disassemble the point of sale device.

Figure 1:
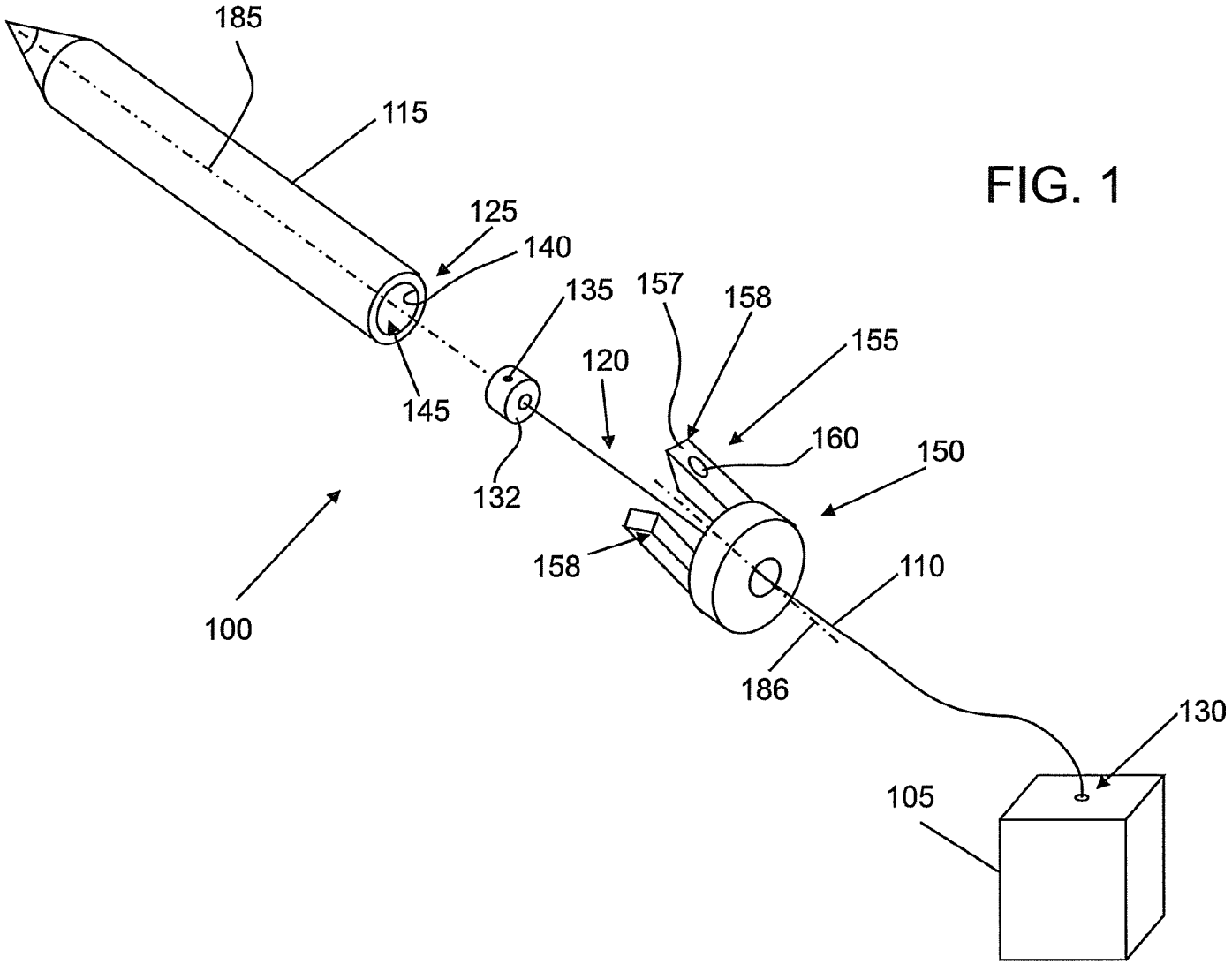
FIG. 1 is a front perspective exploded assembly view of a pen retention device in accordance with an embodiment of the invention.

FIG. 1 depicts an embodiment of a pen retention device 100. The pen retention device 100 includes a retracting reel 105 (also herein referred to as a "tether retracting reel"), a tether 110, such as a string or wire for example, and a pen 115 releasably attached to the tether 110. The tether 110 includes a first end 120 releasably attached to the pen 115 proximate an end 125 thereof. A second end 130 of the tether 110 is in operable communication with the retracting reel 105. The tether 110 is withdrawn from the retracting reel 105 to allow the shopper to utilize the pen 115 to authorize a sales transaction. The retracting reel 105 includes a retraction mechanism such as a spring (not shown) to retract or return the tether 110 within the retracting reel 105 when the pen 115 in not in use. The pen retention device 100 further includes an anvil 132 securedly attached to the first end 120 of the tether 110. The anvil 132 may be attached to the tether 110 via any suitable attachment means, such as via deformation or crimping of the anvil 132 to the tether 110, adhesive, material transformation such as welding, or a mechanical fastener 135, such as a setscrew, for example. An interior surface 140, such as a radially inwardly directed annular interior surface 140 of the pen 115 thereby defines a bore 145. A retention cap 150 includes a radially outwardly expanding retention interface 155 disposed within the bore 145 proximate the end 125. The retention interface 155 includes a radially outwardly directed surface 157 that contacts the surface 140 defining the bore 145. In an embodiment, the retention interface 155 includes at least two discrete axially extending members or legs 155 dimensioned for disposal within the bore 145. The legs 155 may further include radially outwardly directed protrusions 160 for retention of the cap 150 within the bore 145, as will be described further below.

Figure 2:
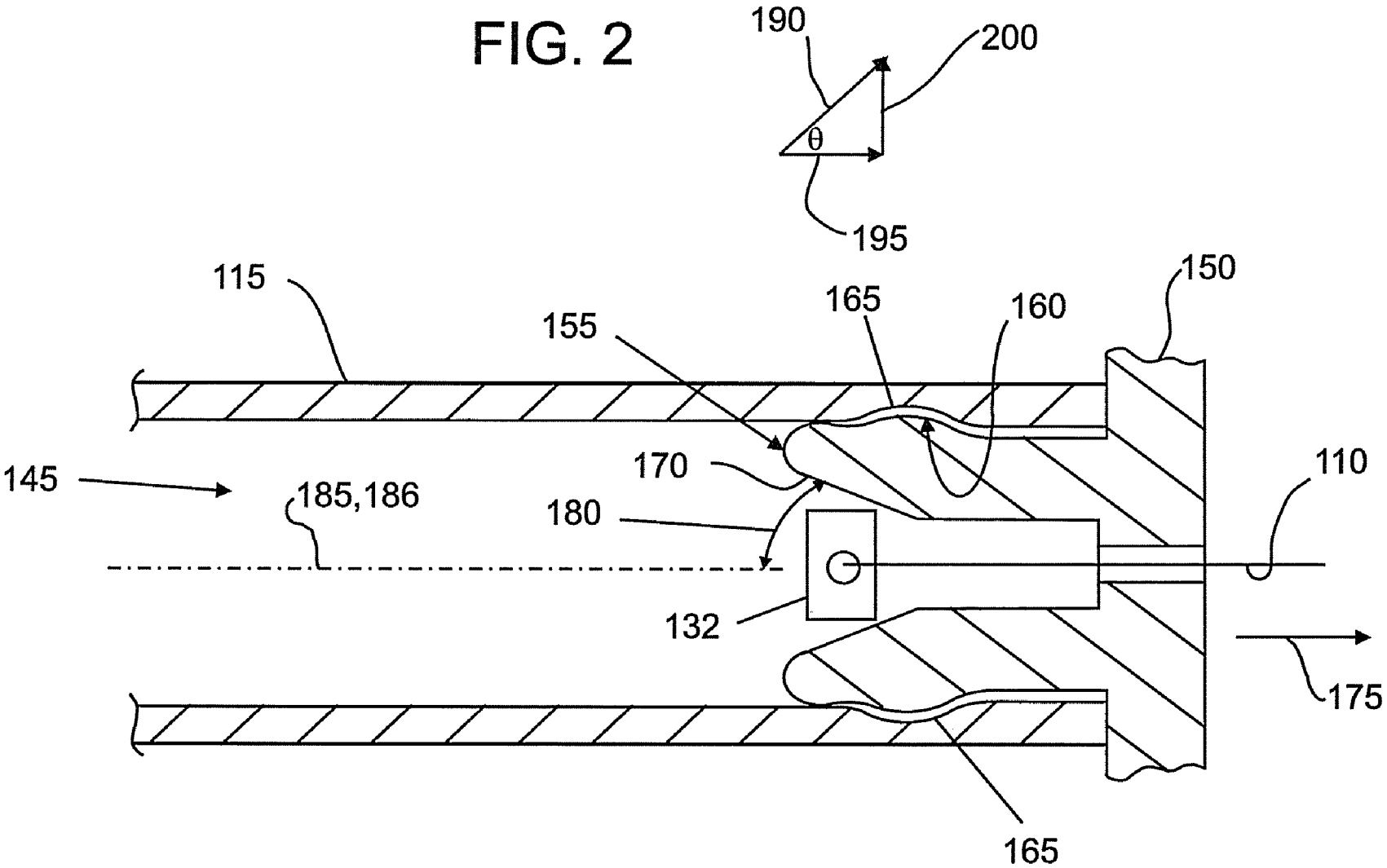
FIG. 2 is an enlarged cross section view of the pen retention device of FIG. 1 in accordance with an embodiment of the invention.

FIG. 2 is an enlarged cross section depicting the relation of the anvil 132, retention interface 155, and pen 115. In an embodiment, the annular interior surface 140 further defines radially outwardly directed recesses 165 having geometry that is complementary to or matches geometry of the protrusions 160. Disposal of the protrusions 160 within the complementary recesses 165 enhances retention of the legs 155 of the cap 150 within the bore 145 of the pen 115. For example, disposal of the protrusions 160 within the complementary recesses 165 increases an amount of force required to release the cap 150 from the bore 145. The protrusions 160 are disposed upon the retention interface 155 at a location along an axial central axis 185 corresponding to a location of the recesses 165 in response to disposal of the retention interface 155 of the cap 150 within the bore 145.

The retention interface 155, such as legs 155 for example, includes one or more radially inwardly directed angled engagement surface 170 in operable communication with the anvil 132. The engagement surfaces 170 are disposed such as to include an angle 180 between the engagement surfaces 170 and an axial central axis 185 of the cap 150. In an embodiment, the angle 180 is greater than zero degrees and less than ninety degrees relative to the central axis 185 of the cap 150. The engagement surfaces 170 are responsive to an application of force in a first direction 175 from the tether 110 via the anvil 132 to produce a reaction force 190 that is directed perpendicular to the engagement surface 170. The reaction force 190 thereby includes a first component 195 that is aligned with the first direction 175 and a second component 200 that is perpendicular to the first direction 175. The retention interface 155 is responsive to the force component 200 to deform or expand in an outward radial direction (parallel to force component 200) toward the interior surface 140 of the pen 115. Deformation of the retention interface 155 in the outward radial direction toward the interior surface 140 increases an amount of normal force (force component 200) applied between the retention interface 155 and the interior surface 140. The force component 200 applied between the retention interface 155 and the interior surface 140 increases a frictional force between the interface 155 and the surface 140 that resists withdrawal of the cap 150 from the pen 115. In an embodiment of the pen retention device 100 that includes the protrusions 160 and recesses 165, resistance to withdrawal of the cap 150 in response to deformation of the retention interface 155 is further increased by the complementary geometry of the protrusions 160 disposed within recesses 165.

Material properties as well as geometry of the retention interface 155 influence an amount of deformation of in response to a given amount of applied force via the anvil 132. Selection of the angle 180 influences a leverage of the force applied to the anvil 132 via the tether 110 to deform the retention interface 155. For example, as the included angle 180 increases, an angle θ between the reaction force 190 and the first component 195 decreases, such that the force component 200 also decreases, thereby reducing an amount of deformation of the retention interface 155 in response to a given force applied to the anvil 132 in the first direction 175.

The retention interface 155 of the cap 150, in conjunction with the interior surface 140 of the pen 115, provide a "breakaway" feature that releases the cap 150 from the pen 115 in response to application of an amount of force from the tether 110 that exceeds a release force. Specifically, the "breakaway" feature releases the cap 150 in response to an application of force greater than the release force by the tether 110 via the anvil 132 to the engagement surface 170. Accordingly, selection of the material properties and geometry of the retention interface 155 influence the release force required to withdraw the cap 150 from the pen 115. Further, the retention interface 155 is responsive to an application of force less than the release force by the tether 110 via the anvil 132 to the engagement surface 170 to expand and secure cap 150 to the pen 115.

In one embodiment, the material properties and geometry of the retention interface 155 are selected to correspond to the release force that releases the cap 150 from the pen 115 prior to damage to (or failure of) either the tether 110 or the retracting reel 105. Therefore, following such release of the cap 150, useful functionality of the retracting reel 105 and tether 110 are preserved. For example, following an inadvertent entanglement of the pen 115 with a purchased product (not shown) the pen 115 releases the cap 150 prior to exertion of a force great enough to damage either the tether 110 or the retracting reel 105. Such release of the cap 150 prior to exertion of a force great enough to damage either the tether 110 or retracting reel 105 is contemplated to reduce a likelihood of shopper injury and allow subsequent reinstallation of the released cap 150. In an exemplary embodiment, the geometry of the interface 155 is selected such that application of approximately 8 to 12 pounds of force to the anvil 132 via the tether 110 results in withdrawal of the cap 150 from the pen 115.

Interaction between the cap 150 and pen 115 may be apparent to the shopper, who may proceed to disentangle the pen 115 from which the cap 150 has been released and to replace the cap 150 into the bore 145 of pen 115. In any event, installation of a replacement pen 115, whether it be the pen 115 from which the cap 150 was released or a new pen 115, is easily accomplished with a need for neither disassembly of the point of sale device (not shown) nor a technician service repair call.

While an embodiment has been described and depicted having two legs as the retention interface, it will be appreciated that the scope of the invention is not so limited, and that embodiments are contemplated to include alternate forms of retention interface, such as a single interface having a cut to allow for expansion, easily deformable material such as rubber, or other numbers of legs, such as three, four, or more, for example. Further, while an embodiment has been described and depicted having cylindrical geometry, it will be appreciated that the scope of the invention is not so limited, and that embodiments are contemplated to include alternate geometry, such as square, pentagonal, hexagonal, or any other releasable geometry, for example.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A pen retention device for releasably securing a pen to a tether, the device comprising:

the pen comprising an end and an annular interior surface defining a bore;

a cap comprising an expanding retention interface, the expanding retention interface disposed within the bore proximate the end and comprising a radially outwardly directed surface in contact with the annular interior surface; and an anvil securedly attached to the tether;

wherein the expanding retention interface further comprises a radially inwardly directed surface in operable communication with the anvil;

wherein the expanding retention interface is responsive to an application of force less than a release force by the tether via the anvil to the radially inwardly directed surface to expand and secure cap to the pen, wherein the expanding retention interface is responsive to an application of force greater than the release force by the tether via the anvil to the radially inwardly directed surface to release the cap from the pen, wherein the expanding retention interface comprises two or more discrete axially extending members, and wherein the anvil is securedly attached to a first end of the tether and the pen retention device further comprising a tether retracting reel in operable communication with a second end of the tether.

2. The pen retention device of claim 1, wherein:

the interior surface of the pen further defines one or more radially outwardly directed recesses;

the expanding retention interface further comprises one or more radially outwardly directed protrusions having geometry complementary to geometry of the recesses; and the protrusions are disposed upon the axially extending members of the expanding retention interface at an axial location corresponding to an axial location of the recesses in response to disposal of the retention interface within the bore.

3. The pen retention device of claim 1, wherein:

the radially inwardly directed surface of the retention interface is disposed at an angle greater than zero degrees and less than ninety degrees relative to an axial centerline of the retention interface.

* * * * *